United States Patent [19]

Belokin

[11] Patent Number: 4,609,173

[45] Date of Patent: Sep. 2, 1986

[54] MAGNETICALLY ATTACHABLE TOWEL HANGER

[75] Inventor: Martin P. Belokin, Denton, Tex.

[73] Assignee: Martin-Paul, Inc., Denton, Tex.

[21] Appl. No.: 656,249

[22] Filed: Oct. 1, 1984

[51] Int. Cl.[4] ..... A47B 96/06

[52] U.S. Cl. ..... 248/225.1; 211/94; 211/105.1; 211/DIG. 1; 248/206.5

[58] Field of Search ..... 248/225.1, 467, 206.5, 248/223.4, 298; 211/94, 105.1, 123, DIG. 1; 335/285

[56] References Cited

U.S. PATENT DOCUMENTS

| | | | |
|---|---|---|---|
| 2,223,680 | 12/1940 | Fischer et al. | 248/298 X |
| 2,371,433 | 3/1945 | Davis | 211/94 X |
| 2,642,999 | 6/1953 | McPherson | 211/DIG. 1 |
| 2,647,641 | 8/1953 | Tritt | 211/123 X |
| 3,023,991 | 3/1962 | Fisher | 248/467 X |
| 3,260,021 | 7/1966 | Katz | 211/105.1 X |
| 4,058,335 | 11/1977 | Abe | 248/206.5 X |
| 4,488,653 | 12/1984 | Belokin | 211/DIG. 1 |

FOREIGN PATENT DOCUMENTS

| | | | |
|---|---|---|---|
| 2450582 | 11/1980 | France | 211/94 |
| 1595578 | 8/1981 | United Kingdom | 211/94 |

*Primary Examiner*—Robert W. Gibson, Jr.
*Assistant Examiner*—Blair Johnson
*Attorney, Agent, or Firm*—James E. Nilles

[57] ABSTRACT

A towel hanger magnetically securable to an upright metal surface comprises a one-piece hanger member of rigid plastic and a one-piece supporting member of extruded elastomeric material impregnated with magnetized material. The hanger member comprises an edgewise upright, horizontally elongated back plate, struts projecting forward from the back plate at its opposite ends, and a rod, preferably of cruciform cross-section, that has its ends connected to the front ends of the struts. The supporting member, which is strip like with a flat rear surface, has a length and width to overlie most of the flat rear surface of the back plate but be concealed by it. Elongated interengaging flanges on the members, projecting rearwardly from the back plate and forwardly from the supporting member and extending lengthwise along those members, provide a lengthwise slidable connection between them.

2 Claims, 5 Drawing Figures

MAGNETICALLY ATTACHABLE TOWEL HANGER

FIELD OF THE INVENTION

This invention relates to hangers such as towel bars that can be quickly and securely mounted on an upright supporting surface without the use of screws, nails or similar fasterners, and it is more particularly concerned with a towel bar or similar hanger that can be instantly secured to an upright metal supporting surface and can be removed just as quickly and easily without leaving a trace.

BACKGROUND OF THE INVENTION

U.S. Pat. No. 3,023,991, issued to J. Fisher in 1962, discloses a towel bar or similar hanger that is securable to an upright supporting surface without the use of screws, nails or the like. It comprises an elongated strip of magnetically permeable metal that is bent along its length to an L-shaped transverse section to have an upright main portion and a forwardly projecting flange extending all along the bottom edge of the main portion. The rear surface of the main portion is coated with adhesive to provide for securement of the strip to an upright supporting surface. A pair of horseshoe magnets having rearwardly projecting legs are magnetically adhered to the front surface of the main portion, one near each end of it, and these magnets cooperate to support a hanger rod in forwardly spaced relation to the strip, the rod being received in the loops of the horseshoe magnets. The forwardly projecting flange on the strip defines a shelf-like ledge that limits downward sliding of the magnets.

In this prior structure the rod and the magnets that support it are of course very readily attachable to the metal strip and detachable from it. Because of its adhesive coating, the metal strip can be attached easily enough to an upright supporting surface. But removal of the strip can present annoying problems because the adhesive coating material necessarily clings to the supporting surface as well as it does to the metal strip, and therefore some of that material inevitably remains on the supporting surface when the hanger is taken down, leaving an unsightly blemish that is hard to clean away.

It often happens that there is a need for a towel bar or similar hanger in a kitchen—and especially in a small kitchen—but there is no suitable wall space on which to mount it. In such cases there is almost always a range, refrigerator or cabinet that presents an accessible upright wall for the mounting of the hanger, but of course the use of screws or the like on such a surface would be out of the question, and the use of an adhesive on it would be undesirable.

It is perhaps obvious in principle that magnetic attachment of a towel hanger to an upright metal wall would satisfy the requirements, but the practical problem that this expedient presents is suggested by the provision of the ledge-like forwardly projecting flange on the metal strip of the above described prior hanger, which was needed to limit downward sliding of the horseshoe magnets. In short, mounting security is the problem with magnetic attachment, and that problem is a severe one because the attachment must not only support the weight of the hanger itself and of a large wet towel that may be hung on it but must also be able to support the further downward force exerted by a person who pulls the towel off of the hanger by its bottom edge. Even if a magnetic attachment prevents the hanger from being pulled off of the wall, it cannot be satisfactory unless it securely restrains the hanger against sliding down and across the wall. Horseshoe magnets such as suggested by the Fisher patent, and magnets of generally similar conventional configurations, would have to be unduly large to provide enough magnetic force to resist sliding, and accordingly they would have to be bulky, unsightly and expensive.

SUMMARY OF THE INVENTION

The general object of this invention is to provide a hanger in the nature of a towel bar which can be magneticaly attached to an upright metal supporting surface and which will not only cling securely to that surface but will firmly resist sliding along and across it notwithstanding that the magnet means for effecting such attachment is not only small and compact in itself but is so arranged on the hanger as to be virtually invisible when the hanger is mounted.

It is another general object of this invention to provide a towel bar or similar hanger which is both inexpensive and attractive in appearance, is capable of being instantly and securely fastened to an upright metal supporting surface such as a side wall of a range or refrigerator, and is removable with equal facility and without leaving a trace.

A more specific object of this invention is to provide a towel bar which achieves the above stated objectives and which can be easily and inexpensively made in the form of two easily assembled parts, one of those parts being a one-piece plastic molding that can be produced with a simple die set and the other being well adapted for production by extrusion.

These and other objects of the invention that will appear as the description proceeds are achieved in the hanger of this invention, which comprises a one-piece hanger member and a one-piece supporting member. The hanger member comprises an elongated back plate with a substantially flat rear surface and an opposite front surface, a pair of struts projecting forwardly from the back plate, one near each end thereof, a rod having opposite ends connected to the front ends of said struts to be supported by them in forwardly spaced relation to the back plate, and an elongated boss projecting rearwardly from the rear surface of the back plate and extending lengthwise along it between its longitudinal edges. The boss has a substantially T-shaped cross-section that is uniform along its length and provides substantially coplanar laterally oppositely projecting retaining flanges that overlie the rear surface of the back plate in rearwardly spaced relation to it. The supporting member is made of an elastomeric material impregnated with magnetic material. It has laterally opposite straight and parallel top and bottom edges and has a transverse cross-section which is uniform along its length, with a substantially flat rear surface for magnetic securement to an upright metal supporting surface, an opposite substantially forwardly facing surface area that is spaced laterally inwardly from its said edges, and a pair of supporting flanges that project edgewise laterally towards one another over said surface area, each of which closely but lengthwise slidably overlies one of the retaining flanges on the hanger member to secure the hanger member to the supporting member.

In a preferred embodiment of the invention, the rod has a substantially cruciform cross-section that is uniform along its length.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 4:
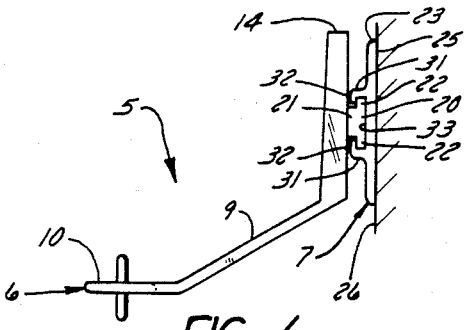
FIG. 4 is a view of the mounted hanger in end elevation.

A hanger 5 that embodies the principles of this invention comprises two main parts, namely a hanger member 6 which can be readily molded in one piece, of a suitable substantially stiff plastic, and a supporting member 7 which can be produced by extrusion and which is made of an elastomeric material impregnated with magnetized material.

The hanger member 6 comprises a relatively long, narrow back plate 8, a pair of struts 9 that project forwardly from opposite end portions of the back plate, and a rod 10 that has its opposite ends connected with the front ends of the struts 9 to bridge across the struts and be supported by them in forwardly spaced relation to the back plate.

The back plate 8 preferably has straight and parallel top and bottom longitudinal edges 14 and 15, respectively, and its front face, which can be substantially flat, can be embossed or otherwise ornamented. As shown, a stiffening rib 17 that projects forwardly a small distance beyond the front face of the back plate extends all along its top edge 14 and merges into a wider downwardly projecting rib 18 along each end edge. Each of the struts 9 forms, in effect, a forward continuation of an end rib 18, so that the ribs 17, 18 not only afford strength and rigidity to the hanger member 6 but also enhance its appearance.

Figure 5:
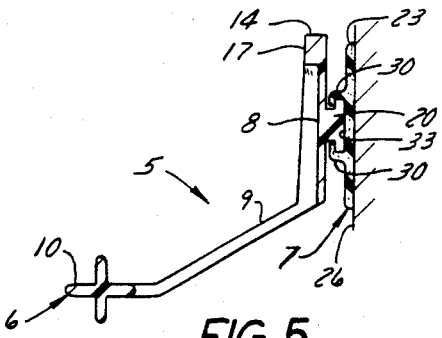
FIG. 5 is a view of the mounted hanger in transverse section.
Figure 2:
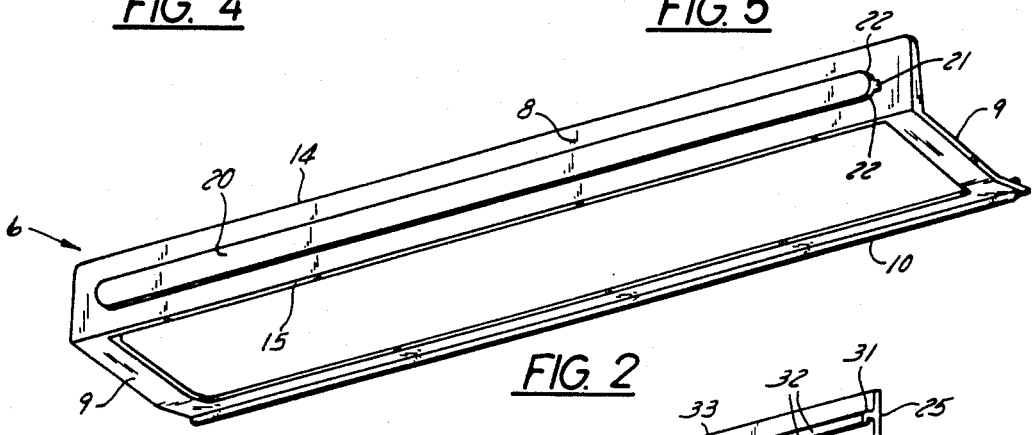
FIG. 2 is a rear perspective view of the hanger member with the supporting member removed from it.
Figure 3:
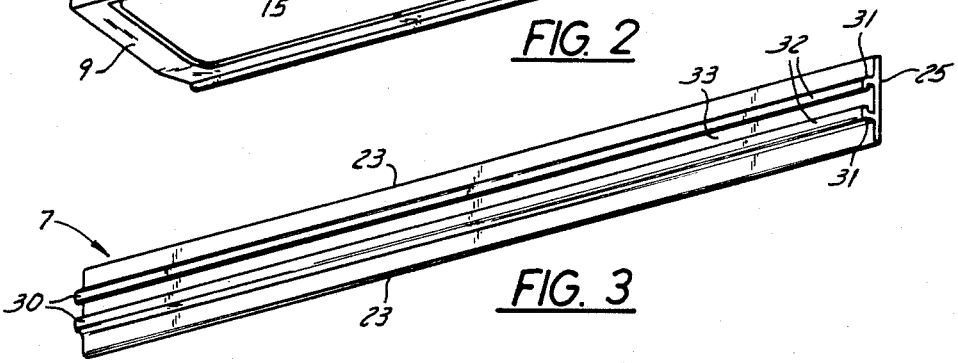
FIG. 3 is a front perspective view of the supporting member.
Figure 1:
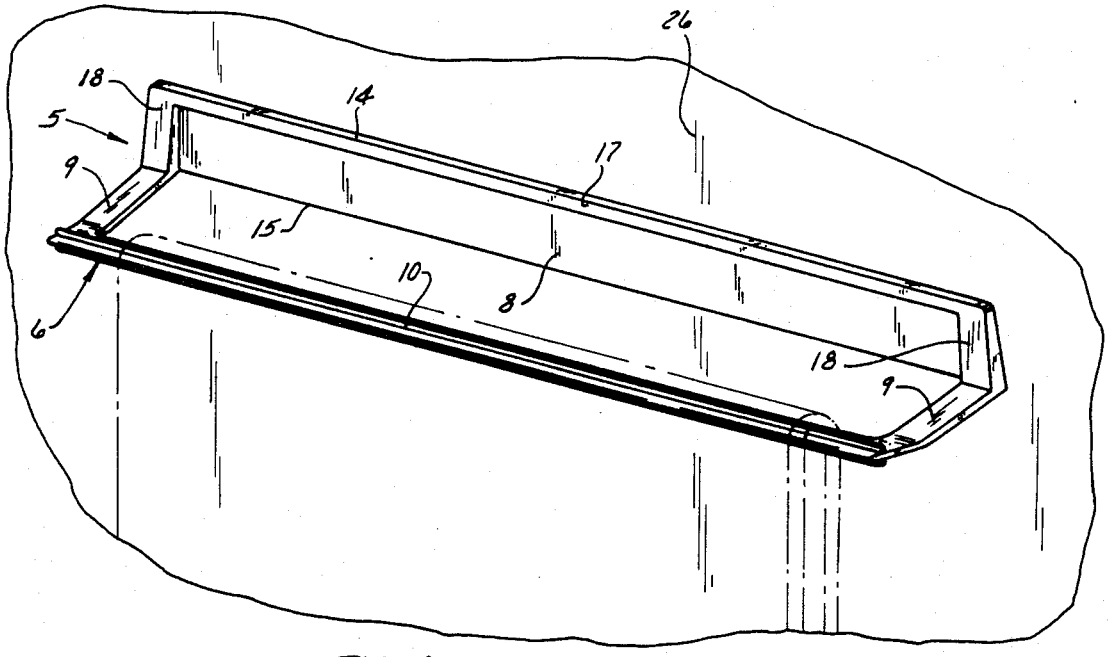
FIG. 1 is a front perspective view of the hanger of this invention, mounted on a supporting surface.

The rear surface of the back plate 8 is for the most part flat, but an elongated boss 20 projects rearwardly from it to provide for connection of the hanger member 6 to the supporting member 7. The boss 20 extends along a major portion of the length of the back plate 8 and is located about midway between its longitudinal edges 14, 15. In transverse cross-section the boss 20 is substantially T-shaped, as best seen in FIGS. 4 and 5, with a rearwardly projecting web portion 21 that supports coplanar laterally oppositely projecting retaining flanges 22 in rearwardly spaced overlying relation to the flat rear surface of the back plate.

The supporting member 7 is strip-like, having straight and parallel longitudinal edges 23. The length of the supporting member 7 is slightly less than that of the hanger member back plate 8, and its width is about equal to that of the back plate, or slightly smaller, so that it is substantially concealed behind the back plate when the members 6 and 7 are connected and mounted.

The supporting member 7 has a flat rear surface 25, to be flatwise magnetically adherent to a flat, upright supporting surface 26. Because the supporting member is of elastomeric material, it is supple and pliant enough to adjust itself to any slight irregularities in the supporting surface and overlie it closely to ensure good magnetic adhesion.

On its front the supporting member 7 has a pair of forwardly projecting channels 30 that are spaced laterally inwardly from its longitudinal edges 23 and extend along its full length. Each of these channels 30 is of substantially L-shaped transverse section, to have a forwardly projecting web 31 and a supporting flange 32 that projects edgewise laterally towards the supporting flange 32 of the other channel and overlies but is forwardly spaced from a flat front surface area 33 of the supporting member that is between the webs 31. As can be seen from FIGS. 4 and 5, the webs 31 of the two channels 30 are spaced apart by a distance equal to the distance between the remote edges of the coplanar retaining flanges 22 of the boss 20 on the hanger member, and the channels 30 define grooves which open laterally towards one another and in which the retaining flanges 22 are lengthwise slidably received with a rather close fit.

The front surface portions of the supporting member 7 that extend laterally outwardly from its channels 30 can be flat and parallel to its rear surface.

It will be observed that the supporting member 7 has a cross-section which is uniform all along its length, and that it can have mirror-image symmetry relative to its longitudinally extending center line so that it can be readily produced with a simple and inexpensive extrusion die in a manner well known in the art. The process for magnetizing the magnetizable particles with which it is impregnated—which process can be performed directly downstream from the extrusion die—is also known, being disclosed, for example, in U.S. Pat. No. 3,191,106 to Baermann. That patent also explains how alternate poles of opposite polarity are obtained all along and across the extrusion so that it can have magnetic adhesion in excess of 200 grams per square inch. Because of this high adhesive force per unit area and the relatively large area of the rear surface of the retaining member 7, it clings tightly enough to a metal wall to resist sliding along it, even if the wall has a very smooth surface.

The rod 10 of the hanger member 5 is preferably of cruciform cross-section, as shown, to have substantially as much rigidity as a more conventional circular-section rod without requiring as much material. The cruciform section rod also has the advantage that a towel or the like has less tendency to slide off of it if it is hung on such a rod with one edge substantially below the other.

From the foregoing description taken with the accompanying drawings it will be apparent that this invention provides an attactive and inexpensive hanger for towels and the like which can be mounted instantly on an upright metal wall such as that of a range or a refrigerator, which remains securely in place without sliding or releasing its attachment, and which can nevertheless be removed instantly without leaving a trace.

What is claimed as the invention is:

1. A hanger for towels and the like that is readily securable to an upright supporting surface and is readily removable therefrom without leaving a trace, said hanger comprising:

A. a hanger member comprising (1) an elongated back plate having opposite longitudinal edges and having a substantially flat rear surface and an opposite front surface, (2) support means connected to the back plate near opposite ends thereof and projecting forwardly beyond its front surface, and (3) a pair of elongated retaining flanges on the rear of the back plate, extending lengthwise parallel to said longitudinal edges thereof and spaced laterally from those edges, said retaining flanges overlying said rear surface of the back plate in rearwardly spaced relation thereto and projecting edgewise in laterally opposite directions; and B. an elongated, strip-like, one-piece supporting member of elastomeric material impregnated with magnetized material (1) having opposite straight and parallel longitudinal edges, (2) having opposite front and rear surfaces which are flat and substantailly parallel to one another across substantially the entire width of the supporting member between its said edges and between which the supporting member is thin enough to be substantially pliant for conformation to an upright metal supporting surface to which said rear surface of the supporting member can have flatwise overlying magnetic securement, (3) having a length and width to be flatwise overlain by a substantially major portion of said rear surface of the back plate but to be concealed behind the back plate, and (4) having a pair of elongated channels of L-shaped cross-section that extend lengthwise parallel to said longitudinal edges of the supporting member, each comprising a web portion which projects forwardly from the front surface of the supporting member and a supporting flange which projects laterally from said web portion and overlies that front surface in forwardly spaced relation thereto, the supporting flanges of said channels projecting edgewise in laterally opposite directions and being lengthwise slidably interengageable with said retaining flanges, said channels being spaced laterally inwardly by substantial distances from said longitudinal edges of the supporting member and being spaced from one another so that there is a substantial pliant portion of the supporting member between the channels and each of those edges and between the two channels.

2. The hanger of claim 1 wherein said support means comprises a rod extending lengthwise parallel to the length of the back plate.

* * * * *